US007997003B2

(12) United States Patent
Dotzler et al.

(10) Patent No.: US 7,997,003 B2
(45) Date of Patent: Aug. 16, 2011

(54) MULTISTAGE CONTINUOUS DRYER, ESPECIALLY FOR PLATE-SHAPED PRODUCTS

(75) Inventors: Alfred Dotzler, Wangen (DE); Anton Hecht, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 923 days.

(21) Appl. No.: 11/918,422

(22) PCT Filed: Apr. 11, 2006

(86) PCT No.: PCT/DE2006/000639

§ 371 (c)(1),
(2), (4) Date: Oct. 12, 2007

(87) PCT Pub. No.: WO2006/108396

PCT Pub. Date: Oct. 19, 2006

(65) Prior Publication Data

US 2008/0282575 A1 Nov. 20, 2008

(30) Foreign Application Priority Data

Apr. 13, 2005 (DE) ..... 10 2005 017 152

(51) Int. Cl.
*F26B 11/00* (2006.01)

(52) U.S. Cl. ..... 34/60; 34/70; 34/80; 34/90; 34/381; 34/413; 34/497; 705/14; 68/18; 68/20; 239/552; 226/1; 226/7; 223/51

(58) Field of Classification Search ..... 34/60, 70, 34/80, 90, 381, 413, 497; 705/14; 239/552; 223/51; 432/23; 226/1, 7; 68/20, 18
See application file for complete search history.

(56) References Cited

U.S. PATENT DOCUMENTS

| | | | | | |
|---|---|---|---|---|---|
| 1,436,037 | A | * | 11/1922 | Heliot | 34/67 |
| 1,720,622 | A | * | 7/1929 | Breton | 134/60 |
| 1,754,483 | A | * | 4/1930 | Paynter | 34/89 |
| 1,865,103 | A | * | 6/1932 | Hill | 34/60 |
| 2,001,322 | A | * | 5/1935 | Burns et al. | 34/628 |
| 2,007,833 | A | * | 7/1935 | Norris | 34/659 |
| 2,302,730 | A | * | 11/1942 | Woolford | 134/72 |
| 2,304,506 | A | * | 12/1942 | Morrill | 26/92 |
| 2,334,854 | A | * | 11/1943 | Zademach | 34/87 |

(Continued)

FOREIGN PATENT DOCUMENTS

AU 6018886 * 1/1978

(Continued)

OTHER PUBLICATIONS

"Die richtige Loesung fuer die Bauplatten-Industrie" ("The Right Solution for the Construction Panel Industry"); Prospectus of Lindauer Dornier GmbH; pp. 6/7; imprint 12/01/LD/02/99.

(Continued)

*Primary Examiner* — Stephen Michael Gravini
(74) *Attorney, Agent, or Firm* — W. F. Fasse; W. G. Fasse

(57) ABSTRACT

In a method and an apparatus for drying plate-shaped products in a multi-level throughflow dryer, moist air stagnated under the housing ceiling is sucked away and delivered into the suction area of axial blowers arranged in the lower levels, where the moist air is then differentially admixed into a quantity of re-heated drying air, and the mixture is delivered to the nozzle boxes of the dryer.

15 Claims, 4 Drawing Sheets

U.S. PATENT DOCUMENTS

| | | | | | |
|---|---|---|---|---|---|
| 2,440,648 | A | * | 4/1948 | Walter et al. | 34/649 |
| 2,554,239 | A | * | 5/1951 | Caulfield et al. | 34/649 |
| 2,596,358 | A | * | 5/1952 | Ball | 34/68 |
| 2,775,020 | A | * | 12/1956 | Boyes | 34/619 |
| 2,777,213 | A | * | 1/1957 | Dungler | 34/652 |
| 2,803,446 | A | * | 8/1957 | Flynn | 432/58 |
| 2,827,276 | A | * | 3/1958 | Racheter | 432/62 |
| 2,952,078 | A | * | 9/1960 | Litzler | 34/68 |
| 3,041,736 | A | * | 7/1962 | Peterson et al. | 34/380 |
| 3,070,902 | A | * | 1/1963 | Oholm | 34/640 |
| 3,078,589 | A | * | 2/1963 | Carlson | 34/77 |
| 3,098,797 | A | * | 7/1963 | Graff et al. | 435/291.8 |
| 3,126,578 | A | * | 3/1964 | Chapman | 100/325 |
| 3,140,157 | A | * | 7/1964 | Fleissner et al. | 34/115 |
| 3,147,180 | A | * | 9/1964 | Berardino et al. | 162/389 |
| 3,147,895 | A | * | 9/1964 | Boyes | 223/51 |
| 3,284,922 | A | * | 11/1966 | Goldenberg et al. | 34/637 |
| 3,384,282 | A | * | 5/1968 | Vits | 226/97.3 |
| 3,447,247 | A | * | 6/1969 | Daane | 34/122 |
| 3,448,524 | A | * | 6/1969 | Hildebrand | 34/612 |
| 3,448,907 | A | * | 6/1969 | Stout et al. | 242/615.11 |
| 3,551,970 | A | * | 1/1971 | Cohn et al. | 6/91 |
| 3,554,502 | A | * | 1/1971 | Rye et al. | 427/542 |
| 3,590,495 | A | * | 7/1971 | Tyson et al. | 34/654 |
| 3,603,001 | A | * | 9/1971 | Arnold et al. | 34/136 |
| 3,622,058 | A | * | 11/1971 | Vits | 226/7 |
| 3,629,953 | A | * | 12/1971 | Fleming | 34/646 |
| 3,665,734 | A | * | 5/1972 | Hauser et al. | 68/18 C |
| 3,739,496 | A | * | 6/1973 | Buckley et al. | 34/210 |
| 3,827,639 | A | * | 8/1974 | Relue et al. | 239/552 |
| 3,936,953 | A | * | 2/1976 | Chance et al. | 34/654 |
| 3,958,920 | A | * | 5/1976 | Anderson | 432/23 |
| 3,991,484 | A | * | 11/1976 | Lamb et al. | 34/659 |
| 4,038,152 | A | * | 7/1977 | Atkins | 201/2.5 |
| 4,137,649 | A | * | 2/1979 | Fleissner | 34/646 |
| 4,227,317 | A | * | 10/1980 | Fleissner | 34/636 |
| 4,349,968 | A | * | 9/1982 | Escande | 34/393 |
| 4,435,909 | A | * | 3/1984 | Williamson, Jr. | 34/82 |
| 4,538,361 | A | * | 9/1985 | Gresens | 34/82 |
| 4,548,623 | A | * | 10/1985 | Naske | 96/230 |
| 4,592,150 | A | * | 6/1986 | Schnupp | 34/136 |
| 4,649,655 | A | * | 3/1987 | Witten | 34/135 |
| 4,663,863 | A | * | 5/1987 | Curry et al. | 34/566 |
| 4,779,356 | A | * | 10/1988 | Hehn | 34/114 |
| 4,793,074 | A | * | 12/1988 | Jessop et al. | 34/653 |
| 4,823,479 | A | * | 4/1989 | Dornier et al. | 34/210 |
| 5,022,167 | A | * | 6/1991 | Nakamura | 34/655 |
| 5,067,254 | A | * | 11/1991 | Linkletter et al. | 34/137 |
| 5,147,690 | A | * | 9/1992 | Faust et al. | 427/372.2 |
| 5,172,844 | A | * | 12/1992 | Mueller | 226/7 |
| 5,190,201 | A | * | 3/1993 | Briggs | 226/1 |
| 5,199,354 | A | * | 4/1993 | Wood | 110/241 |
| 5,289,639 | A | * | 3/1994 | Bard et al. | 34/380 |
| 5,333,395 | A | * | 8/1994 | Bulcsu | 34/79 |
| 5,428,904 | A | * | 7/1995 | Rutz | 34/219 |
| 5,444,925 | A | * | 8/1995 | Bard et al. | 34/638 |
| 5,536,158 | A | * | 7/1996 | Dresie et al. | 425/75 |
| 5,659,972 | A | * | 8/1997 | Min et al. | 34/255 |
| 5,659,975 | A | * | 8/1997 | Bahner et al. | 34/459 |
| 5,678,429 | A | * | 10/1997 | Zonco | 68/20 |
| 5,813,134 | A | * | 9/1998 | Min et al. | 34/255 |
| 6,018,886 | A | * | 2/2000 | Bell et al. | 34/380 |
| 6,058,623 | A | * | 5/2000 | Brooks et al. | 34/362 |
| 6,085,437 | A | * | 7/2000 | Stipp | 34/115 |
| 6,125,550 | A | * | 10/2000 | Kendall et al. | 34/316 |
| RE37,557 | E | * | 2/2002 | Bahner et al. | 34/459 |
| 6,393,719 | B1 | * | 5/2002 | Stipp | 34/115 |
| 6,694,639 | B2 | * | 2/2004 | Hanaya | 34/115 |
| 6,751,889 | B2 | * | 6/2004 | Wells | 34/639 |
| 6,944,970 | B2 | * | 9/2005 | Silverbrook et al. | 34/621 |
| 7,176,415 | B2 | * | 2/2007 | Kamitani et al. | 219/400 |
| 7,254,902 | B2 | * | 8/2007 | Hayasaka et al. | 34/620 |
| 7,316,184 | B2 | * | 1/2008 | Schneider et al. | 101/424.1 |
| 7,526,878 | B2 | * | 5/2009 | Sonobe et al. | 34/266 |
| 7,647,708 | B2 | * | 1/2010 | Christoffersen | 34/589 |
| 2003/0070781 | A1 | * | 4/2003 | Hermans et al. | 162/115 |
| 2005/0155252 | A1 | * | 7/2005 | Silverbrook et al. | 34/621 |
| 2008/0206455 | A1 | * | 8/2008 | Sonobe et al. | 427/162 |
| 2009/0038176 | A1 | * | 2/2009 | Dotzler et al. | 34/219 |

FOREIGN PATENT DOCUMENTS

| | | | | |
|---|---|---|---|---|
| DE | 528 337 | | | 6/1931 |
| DE | 25 54 406 | | | 6/1977 |
| DE | 3140157 | A1 | * | 4/1983 |
| DE | 3147180 | A1 | * | 6/1983 |
| DE | 3147895 | A1 | * | 6/1983 |
| DE | 3622058 | | * | 1/1987 |
| DE | 3739496 | A1 | * | 6/1989 |
| DE | 3991484 | C2 | * | 2/1995 |
| DE | 4435909 | A1 | * | 4/1995 |
| DE | 3448524 | C2 | * | 12/1996 |
| EP | 65940 | A1 | * | 12/1982 |
| EP | 1754483 | A1 | * | 2/2007 |
| EP | 1865103 | A1 | * | 12/2007 |
| FR | 2596358 | A1 | * | 10/1987 |
| FR | 2775020 | A1 | * | 8/1999 |
| FR | 2827276 | A1 | * | 1/2003 |
| GB | 812 042 | | | 4/1959 |
| GB | 2302730 | A | * | 1/1997 |
| GB | 2304506 | A | * | 3/1997 |
| GB | 2334854 | A | * | 9/1999 |
| JP | 54111755 | A | * | 9/1979 |
| JP | 54121242 | A | * | 9/1979 |
| JP | 60172542 | A | * | 9/1985 |
| JP | 61133388 | A | * | 6/1986 |
| JP | 61203459 | A | * | 9/1986 |
| JP | 62117661 | A | * | 5/1987 |
| JP | 63085552 | A | * | 4/1988 |
| JP | 01005979 | A | * | 1/1989 |
| JP | 01010091 | A | * | 1/1989 |
| JP | 02013484 | A | * | 1/1990 |
| JP | 05008373 | A | * | 1/1993 |
| JP | 11119400 | A | * | 4/1999 |
| WO | WO 03070902 | A2 | * | 8/2003 |
| WO | WO 03078589 | A2 | * | 9/2003 |

OTHER PUBLICATIONS

Office Action in U.S. Appl. No. 11/918,421, mailed Dec. 22, 2010, 7 pages, USPTO, Alexandria, VA, USA.

* cited by examiner

MULTISTAGE CONTINUOUS DRYER, ESPECIALLY FOR PLATE-SHAPED PRODUCTS

FIELD OF THE INVENTION

The invention relates to a multi-level throughflow dryer for drying plate-shaped or panel-shaped products, in which drying air is heated by a heater and circulated by blowers over the plate-shaped products, which are transported on several levels through the dryer.

BACKGROUND INFORMATION

Throughflow dryers are conventionally known, with a multi-level construction for drying plate-shaped or panel-shaped products, with means, especially rollers or belt-like means, for the transport of the products within the throughflow dryer. The dryer has several dryer zones which comprise a housing and which are arranged one behind another in a transport direction of the products. In the dryer, drying air circulates in an air circulation method, whereby each dryer zone comprises at least one central heat source and several axial blowers arranged vertically over one another in a blower stand. The axial blowers convey the drying air in a direct path into inflow openings of nozzle boxes arranged over and under the transport means for blowing the drying air onto the plate-shaped products, and then sucking in the moisture laden drying air and again circulating it over the at least one heat source.

Throughflow dryers with the above mentioned features have long been known, also see "Die richtige Lösung für die Bauplatten-Industrie", ("The Right Solution for the Construction Panel Industry"), prospectus of Lindauer DORNIER GmbH, page 6/7, imprint 12/01/LD/02/99.

In the known multi-level throughflow dryers, in which moisture is withdrawn or extracted from the products to be dried by high-temperature tempered or heated air, the moisture laden air proceeds in an air circulation loop as low temperature tempered or heated air to the at least one heat source and thereafter as high temperature tempered air back to the blowers.

Measurements for determining the residual moisture in the products, which leave the throughflow drier at the end of the drying process, have shown that products that pass through the dryer in the lower levels of the throughflow dryer have a smaller residual moisture than products that pass through the throughflow dryer in the upper levels. The cause of the differing residual moisture in the finished dried products is to be searched for in the fact that a portion of the moisture laden tempered circulation air, due to its thermodynamic characteristics, stagnates in the upper levels of the throughflow dryer. Thus, the stagnant circulation air can contain, for example, 40 grams of $H_20$ per 1 kg of air. Because this circulation air comprising a relatively high saturation degree of water is positively again directed to the product by means of the blowers allocated to the upper levels through the blowing boxes of the upper levels, the moist drying air blown onto the product to be dried cannot withdraw or extract the desired water quantity from the products. Accordingly, the dried products exit with a differing proportion or content of residual moisture corresponding to the levels of the dryer that were passed through. The invention of the patent application comes into play at this point.

SUMMARY OF THE INVENTION

It is an object of the invention, in a multi-level dryer embodied as a throughflow dryer, to provide such conditions that the proportion or content of the residual moisture in the dried products is nearly constant at the end of the drying process, independent of the level of the throughflow dryer that was passed through.

The object is achieved according to embodiments of the invention by the characterizing features set forth herein.

In a particular embodiment of the invention, the moist air that stagnates below the upper horizontal housing preferably of each dryer zone is sucked off and differentially admixed into the drying air that is to be delivered to the lower levels. The admixture is carried out in such a manner that the quantity or proportion of the admixed moist air is the largest in the first lower level of the dryer zone, while the admixing proportion diminishes in the direction of the upper levels. The moist air quantity per each suction area of the axial blower in that regard can amount to up to approximately 30% of the drying air quantity that can be sucked in by the axial blower.

According to another embodiment of the invention, a vertically extending air channel that is dimensioned sufficiently large in its cross-section is integrated in a vertically extending part of the housing of at least several dryer zones and particularly in the area of the housing of the blower stands. In that regard, the free end of the air channel lying opposite to the horizontally extending part of the housing, forms, spaced away from the housing part, an inflow opening for the circulation air saturated with water (stagnant moist air). In order to be able to suck in or away the water saturated circulation air through the inflow opening, the air channel has, in the channel wall of the air channel lying opposite to the immediate or direct suction area of each blower, openings for the differentiated sucking-in of the moisture laden circulation air that is stagnated under the horizontal part of the housing. In further embodiment features of the inventive solution, the cross-sectional shape of the openings in the channel wall is freely selectable and the size of the opening is adjustable.

Further it is provided according to the invention, that for non-adjustable openings, the size of the openings diminishes in the direction of the inflow opening of the air channel.

With the inventive solution, in an advantageous manner, the water saturated circulation air stagnated under the horizontal housing is sucked in the direction of the lower levels of the throughflow dryer, and is differentially directed or introduced to the circulation air flowing over the heat source. In this manner, a nearly uniform residual moisture is achieved in the products, independent of which level the product to be dried passes through in the throughflow dryer.

BRIEF DESCRIPTION OF THE DRAWINGS

The invention will be explained in more detail in the following in connection with an example embodiment.

In the drawings.

DETAILED DESCRIPTION OF EXAMPLE EMBODIMENTS OF THE INVENTION

Figure 1:
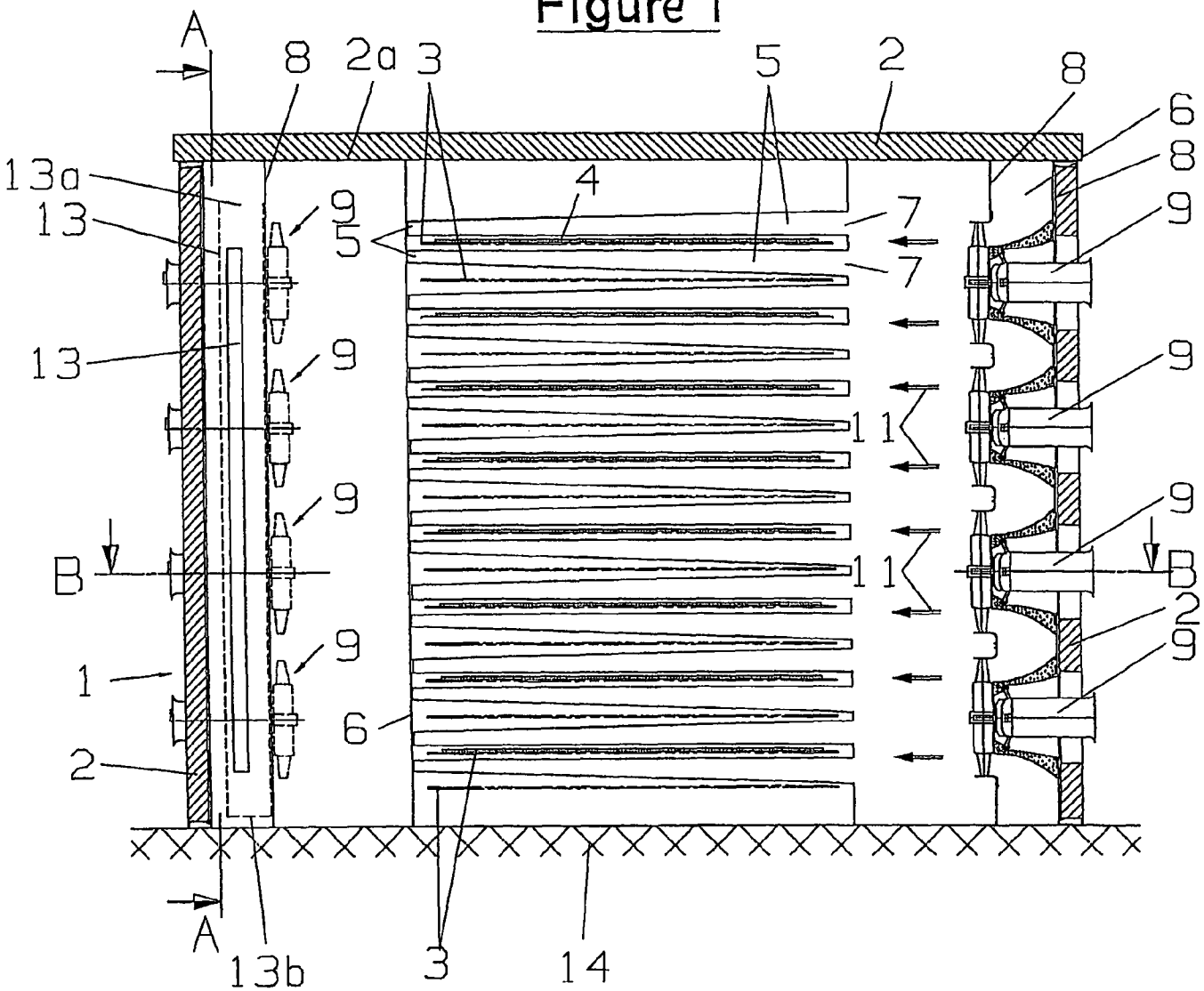
FIG. 1 shows the sectional illustration of a throughflow dryer in a multi-level construction with axial blowers in a vertical arrangement.

In the dryer zone 1, schematically illustrated according to FIG. 1, of a multi-level throughflow dryer consisting of several such dryer zones, each dryer zone comprises a housing 2. The housing 2 consists of one horizontally and several vertically extending heat insulation walls, and encloses several dryer levels. A screen belt endlessly running around rollers, which are not illustrated, as transport means 3 for the product 4 to be dried, for example a fiber panel, is guided in each dryer level. The individual transport means 3 embodied as screen belts are driven by means that are not shown here. Furthermore, over the length of the dryer zone 1, several pairs of so-called nozzle boxes 5 are arranged on a frame-like rack or stand 6 under and over the transport means 3. On its one end, each nozzle box 5 has an inflow opening 7, while its other end is closed. Each nozzle box 5 comprises outflow openings lying opposite the transport means 3, in the present case the screen belt. Below the housing 2, in each dryer zone, at least one blower stand 8 with several axial blowers 9 arranged vertically over one another is installed, blow the drying air that is heated by at least one heat source 10 in an air circulation method into the nozzle boxes 5, as indicated by the direction arrows 11. The drying air that is heated and blown into the nozzle boxes comes onto the product 4, as explained above, via so-called slit or slot nozzles or otherwise embodied openings of the blower boxes 5, that lie opposite to the transport means 3 or the product lying on the transport means, whereby the drying air withdraws or extracts from the product 4 the moisture contained therein, down to a percentage residual moisture proportion or content, which the product 4 comprises at the end of the dryer process.

The disadvantages arising in the drying process of plate-like products in such a multi-level throughflow dryer are already represented in the prior art insofar as the thermodynamic behavior of the moisture laden drying air leads to the condition that drying air with a high moisture content stagnates under the horizontally extending housing 2 of the throughflow dryer 1, namely under the ceiling thereof, and this stagnating drying air is again directed or introduced into the horizontally circulating circulation air in the upper levels of the throughflow dryer. The result is that the relative moisture content in the products at the end of the drying process is differently or variously large and can only be compensated or evened-out through a high technical effort or expenditure, for example on the heat sources. While the products 4 running through the dryer in the lower levels, for example in the twentieth zone of thirty total, have a residual moisture of approximately 36%, the products of the upper levels comprise an increasingly higher residual moisture of, for example, 39%.

Figure 2:
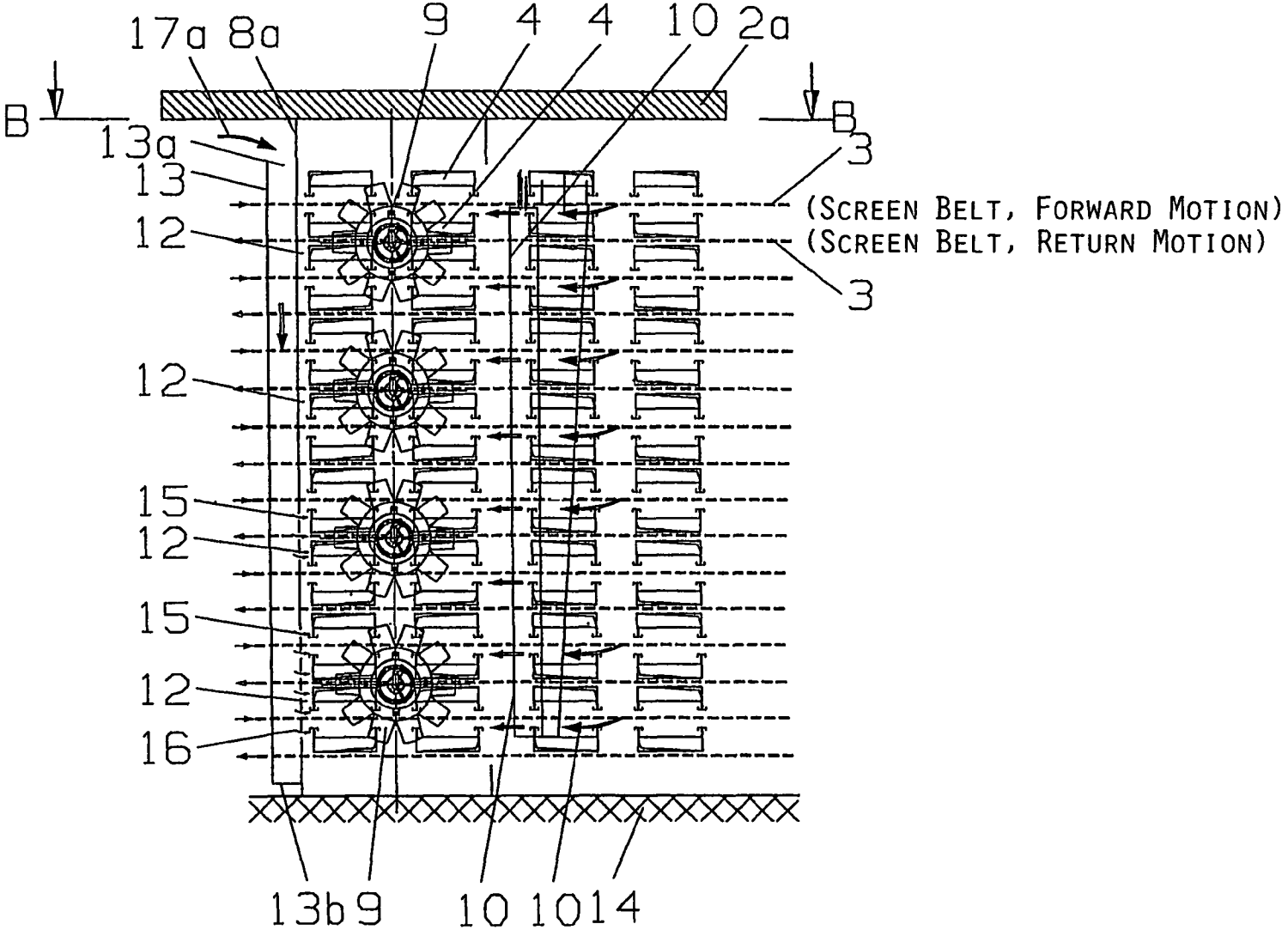
FIG. 2 shows the air channel integrated according to the invention in a dryer zone of the throughflow dryer according to FIG. 1 along line A-A.

The inventive measure shown in FIG. 2 removes or avoids the differences with respect to the proportion or content of the residual moisture in the products 4. A longitudinal section according to the line A-A in FIG. 1 makes it clear in FIG. 2 that a flow channel 13 with an inflow opening 13*a* facing toward the housing ceiling, which channel extends over all levels and ends with a spacing distance below the inner side of the horizontal housing 2*a*, is arranged on the side of the axial blower suction areas 12 facing away from the heat source 10, as best to be seen in FIG. 3, and particularly on the wall 8*a* of the blower stand 8. The other end 13*b* of the flow channel 13 facing toward the foundation 14 of the dryer zone 1 is closed.

For making the proportion or content of the residual moisture in the products 4 uniform, it is provided according to the invention to introduce openings 15 into the wall 8*a* of the blower stand 8 carrying the suction channel 13, and particularly in the area of the blower suction areas 12, to differentially suck away the drying air, which comprises a high moisture proportion or content and is stagnated under the housing ceiling, through the openings 15 and the inflow opening 13*a*, and to direct or introduce this drying air into the circulation air circuit or loop of the lower levels, as this is indicated with the direction arrows 16.

Figure 3:
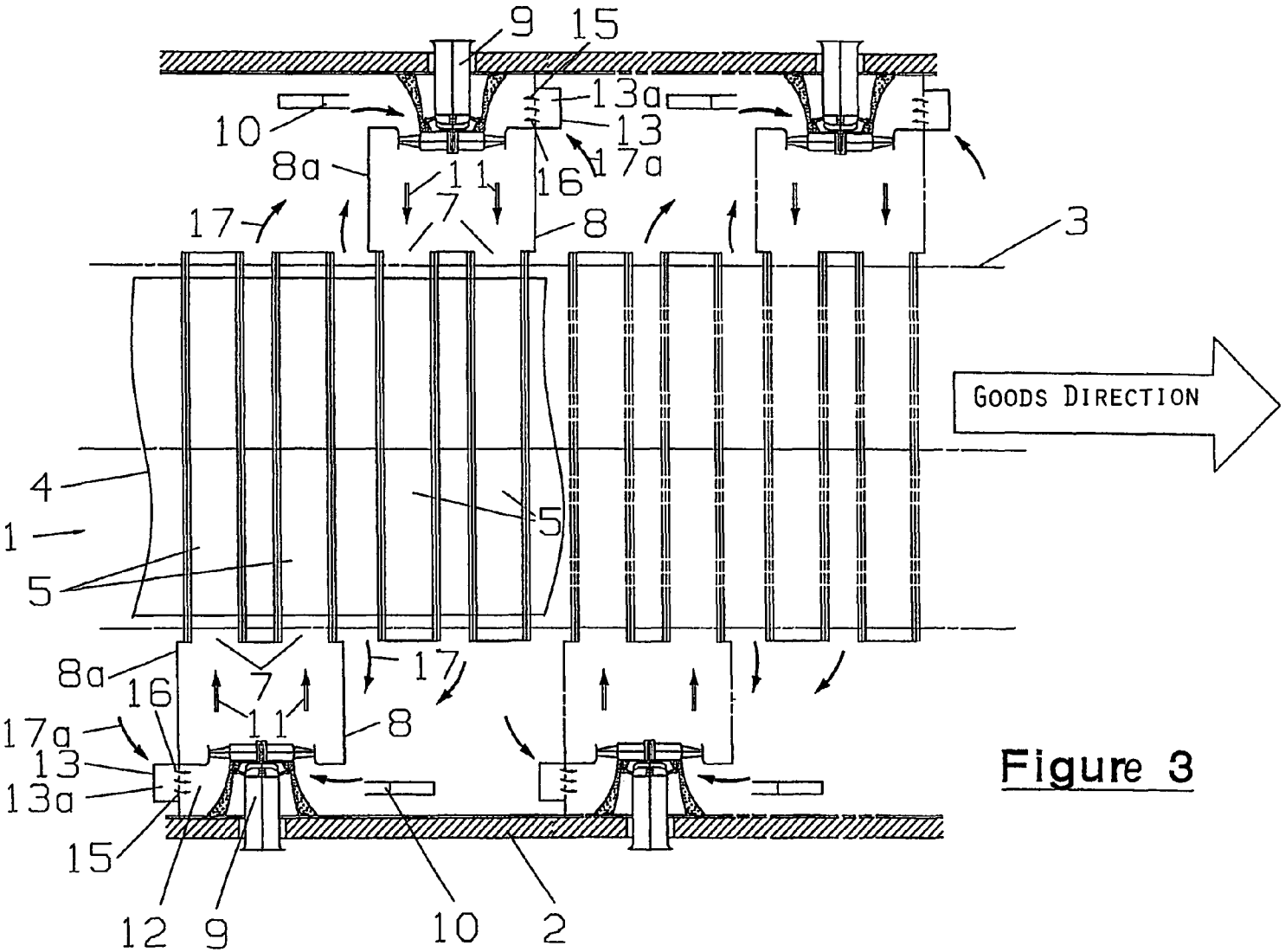
FIG. 3 shows the top view of a dryer zone along line B-B in FIG. 2.

FIG. 3 shows 2 dryer zones 1 of a throughflow dryer according to the line B-B in FIG. 2. The inflow openings 7 of the respective two pairs of nozzle boxes 5 are connected over the totality of the levels of the dryer zone 1 to a blower stand 8 embodied in the manner of an air channel.

The drying air according to direction arrow 11 flows over the product 4 to be dried and takes up moisture therefrom. The direction arrows 16 symbolize the moisture laden drying air. A portion of the moisture laden drying air according to the direction arrow 17 is directed over the heat source 10 and is again directed or supplied as drying air according to the direction arrow 11 to the drying of the product 4. A different portion of the moisture laden drying air stagnates according to the direction arrow 17*a* under the ceiling of the applicable dryer zone 1. This portion of moisture laden drying air is sucked away through the openings 15 and the flow channel 13 by means of the axial blowers 9, and is admixed to the drying air according to direction arrow 17*a*.

Figure 4:
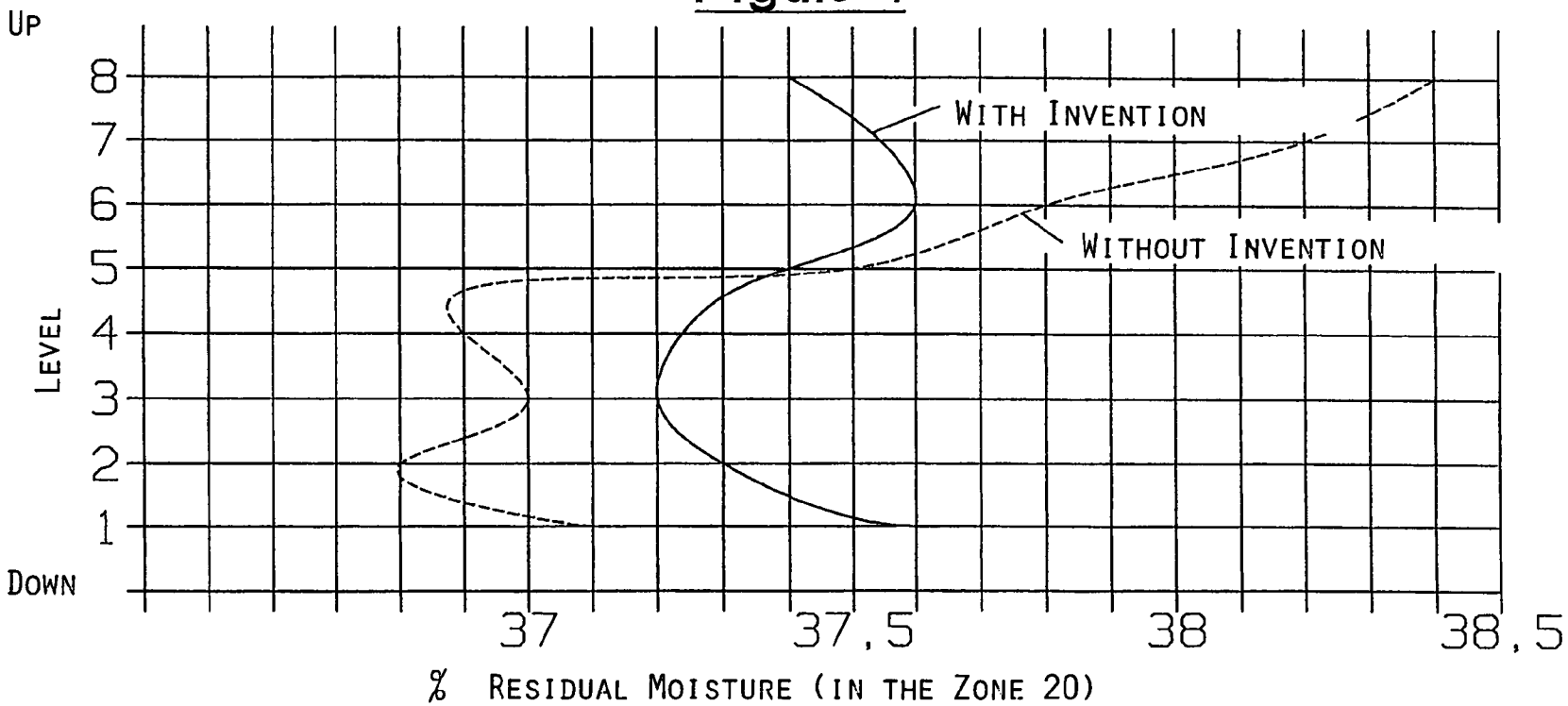
FIG. 4 shows a diagram with a comparative illustration of the residual moisture content in the dried product with and without the inventive solution.

FIG. 4 depicts, in a diagram, the measured proportion or content of the residual moisture in a plate-shaped product after passing through 20 dryer zones of a multi-level throughflow dryer consisting of, for example, 30 dryer zones and having an essentially horizontal air circulation loop or circuit, without and with the inventive solution. The percentage proportion or content of the residual moisture is entered on the abscissa of the diagram while the number of the levels is indicated on the ordinate. The temperature of the drying air was approximately 350° C. The temperature of the moisture laden drying air was approximately 280° C. Without the inventive solution, after ⅔ of the dryer length in the lower levels, to which the levels 1 to 5 belong in the present case, the proportion or content of measured residual moisture in the product 4 amounted to between 36.8% and 37.5%, while the proportion or content of the residual moisture in the product of the levels 6 to 8 was already between 37.8% and 38.4%. Thus, a clearly differing proportion of the residual moisture is present after the drying process, as is shown by the dashed line in the diagram. The inventive solution has made clear in a surprising manner, that the proportion of the residual moisture in the products of the lower levels of the dryer is slightly larger, and is considerably reduced in the levels 6 to 8, as is shown by the continuous or solid line in the diagram. Thus, in an advantageous manner, with the inventive solution a more-uniform residual moisture in the panels is achieved over all levels. This leads to increasing the production quantity with the same energy input. Moreover, an improvement of the quality of the products is achieved.

It is still further pointed out that the above disclosed invention is also useable for products from which no water needs to be withdrawn or extracted, but rather that merely need to be subjected to a thermal treatment (thermobonding). In this case, the air channel integrated in the blower stand can act opposite to or counteract the thermally re-tempered air and cause the air temperature in the dryer levels to become uniform.

The invention claimed is:

1. A multi-level dryer adapted to dry plate-shaped products, said dryer having at least one dryer zone, each of which comprises:

a housing that includes a housing ceiling at a top of said housing, with an air collecting space formed within said housing under said housing ceiling;

plural transport devices that are arranged at plural levels above one another in said housing, and that are adapted to transport the plate-shaped products horizontally through said housing at product locations respectively at said plural levels;

plural air distribution boxes that are arranged above one another and respectively between said product locations, and that have air distribution openings directed at the product locations;

plural blowers that are arranged above one another in said housing;

at least one air circulation path extending in a circuit from a pressure side of said blowers via said air distribution boxes along said product locations and back to suction sides of said blowers;

at least one heater interposed in said air circulation path upstream from said suction sides of said blowers and downstream from said product locations; and a vertically extending air channel that extends vertically in said housing adjacent to said blowers, wherein said air channel has an inlet opening in said air collecting space under said housing ceiling, said air channel has plural outlet openings adjacent to said blowers and communicating with said suction sides of said blowers, and said air channel establishes a secondary air path from said air collecting space to said suction sides of said blowers.

2. The multi-level dryer according to claim 1, wherein said air collecting space is located above an uppermost one of said levels and is adapted to accumulate stagnated moist air in said housing above said levels, and wherein said secondary air path bypasses said at least one heater and is adapted to deliver said moist air from said air collecting space to said suction sides of said blowers bypassing said at least one heater and without heating of said moist air by said at least one heater.

3. The multi-level dryer according to claim 1, wherein said outlet openings of said air channel have adjustable opening sizes.

4. The multi-level dryer according to claim 1, wherein said outlet openings of said air channel at different heights in said dryer, relative to one another, respectively have different opening cross-sectional areas.

5. The multi-level dryer according to claim 4, wherein said opening cross-sectional areas of said outlet openings, relative to one another, diminish upwardly.

6. The multi-level dryer according to claim 1, wherein said outlet openings of said air channel respectively have different cross-sectional shapes, and said shapes are adjustable.

7. The multi-level dryer according to claim 1, wherein said inlet opening of said air channel is an open upper end of said air channel adjacent to and spaced apart from said housing ceiling.

8. The multi-level dryer according to claim 1, wherein said air distribution boxes include air feed boxes and air return boxes arranged in series in said circuit of said air circulation path, with said product locations between said air feed boxes and said air return boxes in said circuit, and with said at least one heater between said air return boxes and said blowers in said circuit.

9. The multi-level dryer according to claim 1, further comprising a blower stand forming a blower plenum extending vertically alongside said transport devices, wherein said blowers are mounted on said blower stand with said pressure side of said blowers communicating into said blower plenum, said blower stand is connected to said air distribution boxes with said blower plenum communicating to said air distribution openings through said air distribution boxes, and said at least one heater and said air channel are each receptively arranged adjacent to and outside of said blower stand with said air channel on an opposite lateral side of said blowers relative to said at least one heater.

10. A method of drying moisture-laden plate-shaped products, comprising:

a) horizontally transporting plural plate-shaped products respectively on plural levels above one another;

b) blowing onto said plate-shaped products a differentially mixed flow of drying air from pressure sides of plural blowers, which are arranged at different heights above one another, wherein said drying air becomes moisture-laden by taking up moisture from said plate-shaped products;

c) heating a first portion of said moisture-laden drying air and flowing said first portion to suction sides of said plural blowers;

d) flowing a second portion of said moisture-laden drying air to an air collecting space above said levels;

e) flowing said second portion of said moisture-laden drying air downwardly from said air collecting space, and flowing respective different proportions of said second portion of said moisture-laden drying air respectively to said suction sides of said plural blowers at said different heights; and f) mixing said first portion at said suction sides respectively with said different proportions of said second portion at said suction sides of said blowers at said different heights and thereby preparing said differentially mixed flow of said drying air, which comprises said first portion respectively mixed with said different proportions of said second portion respectively at said blowers at said different heights.

11. The method according to claim 10, wherein said different proportions of said second portion of said moisture-laden drying air, relative to one another, are largest at a lowermost one of said blowers and diminish toward an uppermost one of said blowers.

12. The method according to claim 10, wherein each one of said different proportions respectively amounts to no more than 30% of a total airflow being blown by a respective associated one of said blowers.

13. The method according to claim 10, wherein said second portion of said moisture-laden drying air is not heated.

14. The method according to claim 10, wherein said different proportions are each respectively differently adjustable.

15. The method according to claim 14, further comprising differently adjusting said different proportions to achieve a more-uniform moisture content of said plate-shaped products exiting from a dryer apparatus in which said method is performed.

* * * * *